US006030319A

United States Patent [19]

Wu

[11] Patent Number: 6,030,319

[45] Date of Patent: Feb. 29, 2000

[54] FOLDABLE CROSS-COUNTRY SKIING EXERCISER

[75] Inventor: Jack Wu, Taipei, Taiwan

[73] Assignee: Modas Shing Company Ltd., Taipei, Taiwan

[21] Appl. No.: 09/292,367

[22] Filed: Apr. 15, 1999

[51] Int. Cl.[7] ..... A63B 22/00; A63B 23/04

[52] U.S. Cl. ..... 482/51; 482/70

[58] Field of Search ..... 482/51, 52, 53, 482/57, 70, 79, 80, 54

[56] References Cited

U.S. PATENT DOCUMENTS

| | | | |
|---|---|---|---|
| 5,102,380 | 4/1992 | Jacobson et al. | 482/54 |
| 5,336,141 | 8/1994 | Vittone | 482/51 |
| 5,616,103 | 4/1997 | Lee | 482/51 |
| 5,792,027 | 8/1998 | Gvoich | 482/51 |
| 5,830,114 | 11/1998 | Halfen et al. | 482/70 |
| 5,857,940 | 1/1999 | Husted | 482/51 |

*Primary Examiner*—Stephen R. Crow
*Attorney, Agent, or Firm*—Rosenberg, Klein & Lee

[57] ABSTRACT

A foldable cross-country skiing exerciser is disclosed. The exerciser includes I shaped base having a first bracket and a second bracket securely mounted thereon, a pair of rods respectively and pivotally received in the first and the second brackets, two pairs of dangling arms pivotally connected with the rods and a pair of sliders each pivotally received between a pair of dangling arms. Both of the rods each have a locking means to selectively fix the rods with respect to the base. The first bracket has an elongate through hole so that the rod pivotally received in the first bracket is movable with respect to the base. Therefore, after the rod in the second bracket is folded, the rod in the first bracket is moved upward along the elongate through hole and folded on top of the folded rod for storage.

3 Claims, 7 Drawing Sheets

FOLDABLE CROSS-COUNTRY SKIING EXERCISER

BACKGROUND OF THE INVENTION

1. Field of the Invention

The present invention relates to a cross-country skiing exerciser and more particularly to a foldable cross-country skiing exerciser, which can be folded to reduce the space for storage.

2. Description of Related Art

FIG. 7 shows a conventional cross-country skiing exerciser. The exerciser has a I shaped base (80), two opposed rods (81) securely extending upward from the base (80) and each having a pair of rolling tubes (810) respectively and pivotally mounted on the rod (81), a pair of U-shaped gliders (82) each securely mounted between two correspondingly opposed rolling tubes (810) on the rods (81) and having a pad (83) for a user to stand thereon and a handle (84) rotatably mounted on the corresponding distal end of each glider (82). With such an arrangement, the user stands on the pads (83) and performs the cross-country ski motion to work out the body. Although this cross-country skiing exerciser does have a positive effect on the user's heart, it still has shortcomings.

Because the rods (81) are securely connected to the base (80), the user will have to have a suitable space to store the exerciser. Furthermore, since each of the gliders (82) is attached to the correspondingly opposed pair of rolling tubes (810), the user will have to find a place to store the exerciser that has clearance greater than the height of the assembled exerciser. This can be quite difficult for users living in a compact metropolitan apartments.

It is an object of the invention to provide a foldable cross-country skiing exerciser to mitigate and/or obviate the aforementioned problems.

SUMMARY OF THE INVENTION

The objective of the present invention is to provide a foldable cross-country skiing exerciser, which can be folded when not in use, so that the space for storage can be much more effectively used.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
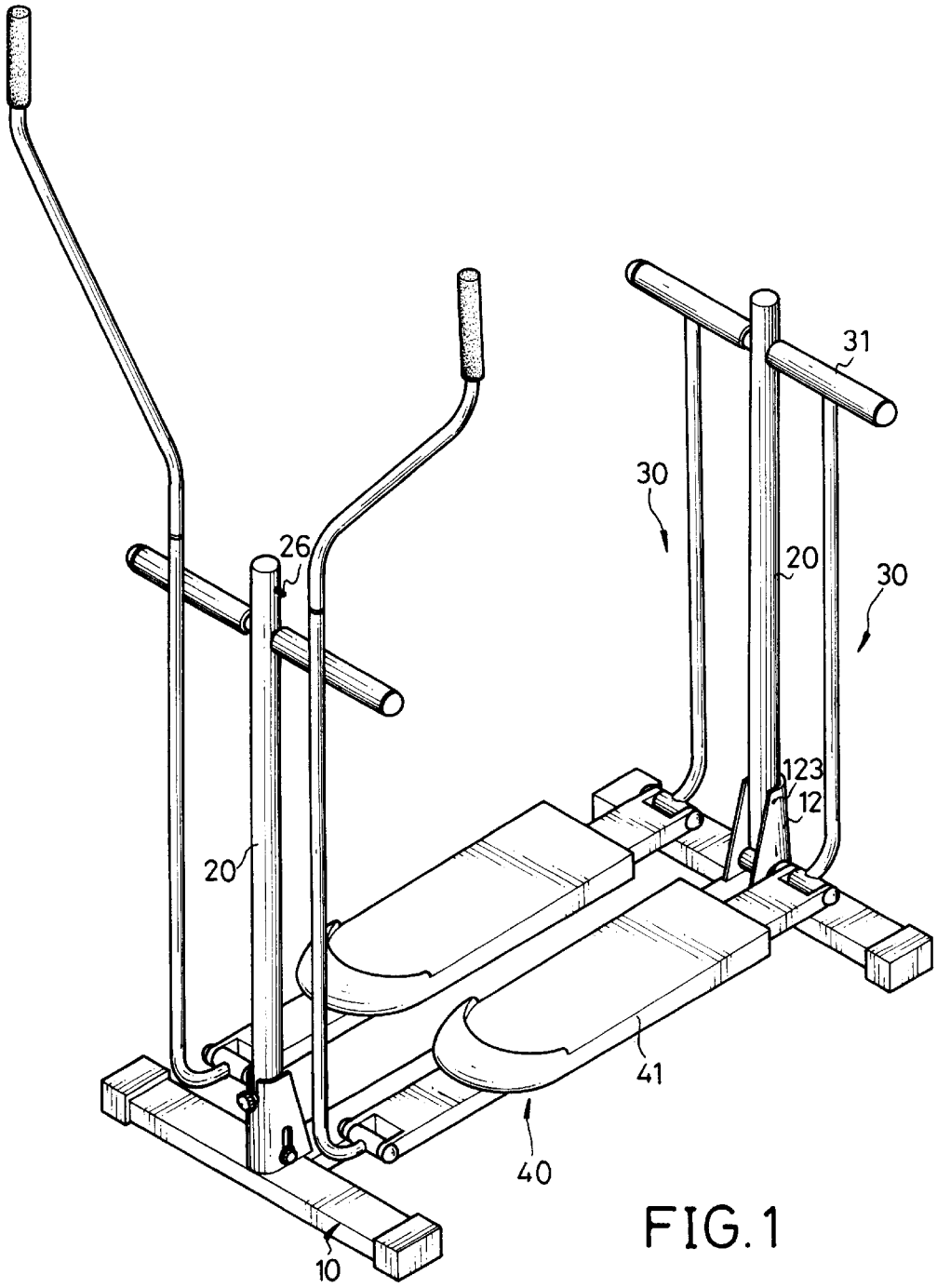
FIG. 1 is a perspective view of a cross-country skiing exerciser in accordance with the invention.
Figure 2:
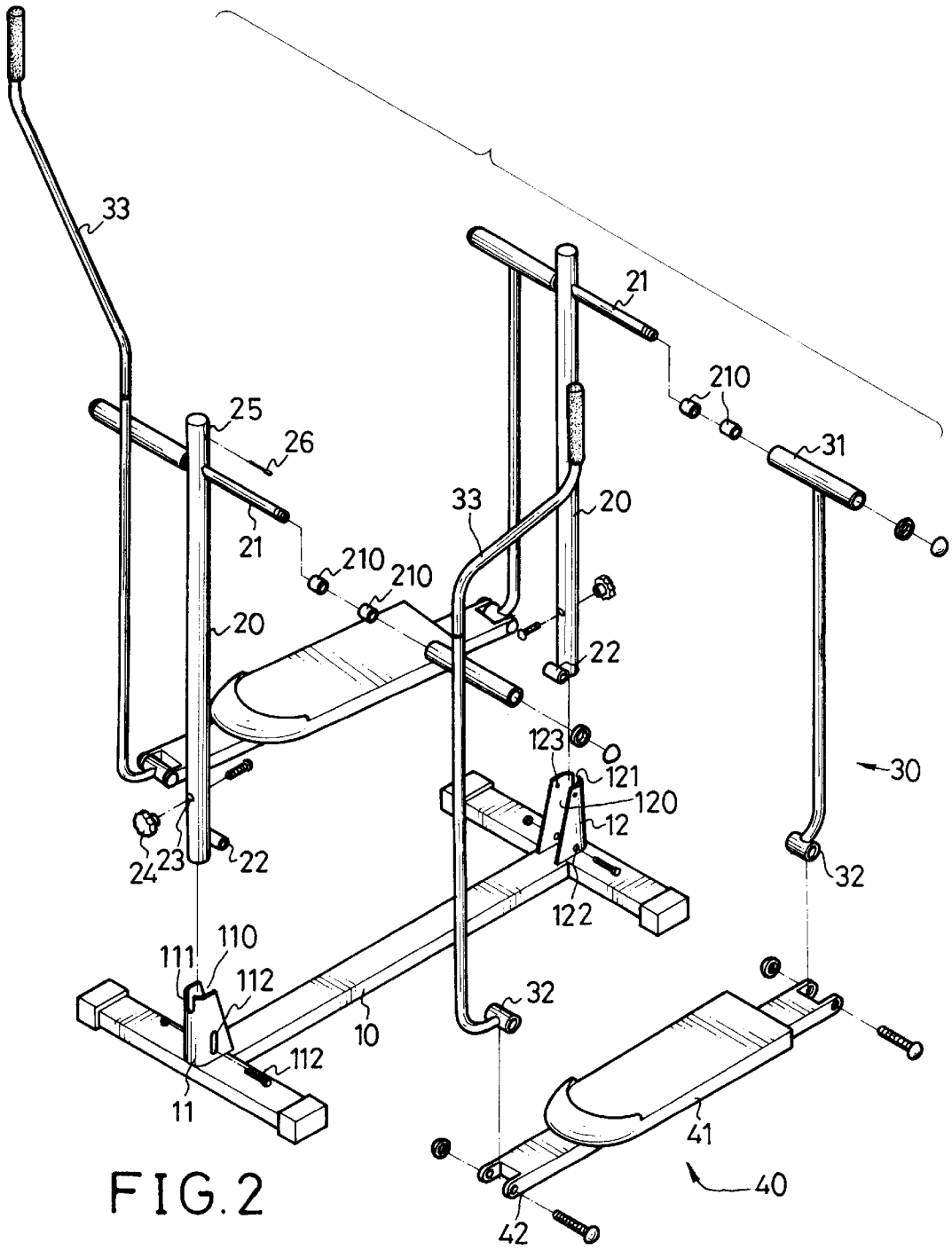
FIG. 2 is an exploded perspective view of the exerciser in FIG. 1.

As shown in FIGS. 1 and 2, a foldable cross-country skiing exerciser in accordance with the invention includes a I shaped base (10), a pair of rods (20) respectively and pivotally mounted on opposed ends of the base (10), two pairs of dangling arms (30) each pivotally and respectively mounted on opposed sides of the rod (20) and a pair of sliders (40) each pivotally connected between two opposite dangling arms (30) and provided with a foot rest (41) securely mounted thereon for receiving a user's foot thereon.

The base (10) has a hollow tapered U-shaped first bracket (11) and a hollow tapered U-shaped second bracket (12) respectively and securely mounted on opposite sides thereof. Both the first bracket (11) and the second bracket (12) have an open side (110, 120) defined to correspond to each other, a cutout (111, 121) defined on the side opposite to the open side (110, 120). The first bracket (11) further has an elongate through hole (112) and the second bracket (12) further has a pivoting hole (122) and a positioning hole (123) respectively defined through the side faces thereof.

Each of the rods (20) has a horizontal pole (21) extending through an upper portion thereof, a connection tube (22) securely connected to a lower portion thereof and pivotally received in the respective first and second brackets (11, 12) and a through hole (23) peripherally defined therethrough so as to allow a locking means (24) to threadingly connected therethrough and abut the edge of the cutout (111, 121) of the first and second brackets (11, 12). A bolt and nut (neither numbered) combination is preferably used to mount the rods (20) in the first and the second brackets (11, 12) by inserting through the elongate through hole (112) of the first bracket (11) and the connection tube (22) and the pivoting hole (122) of the second bracket (12) and the connection tube (22).

Figure 3:
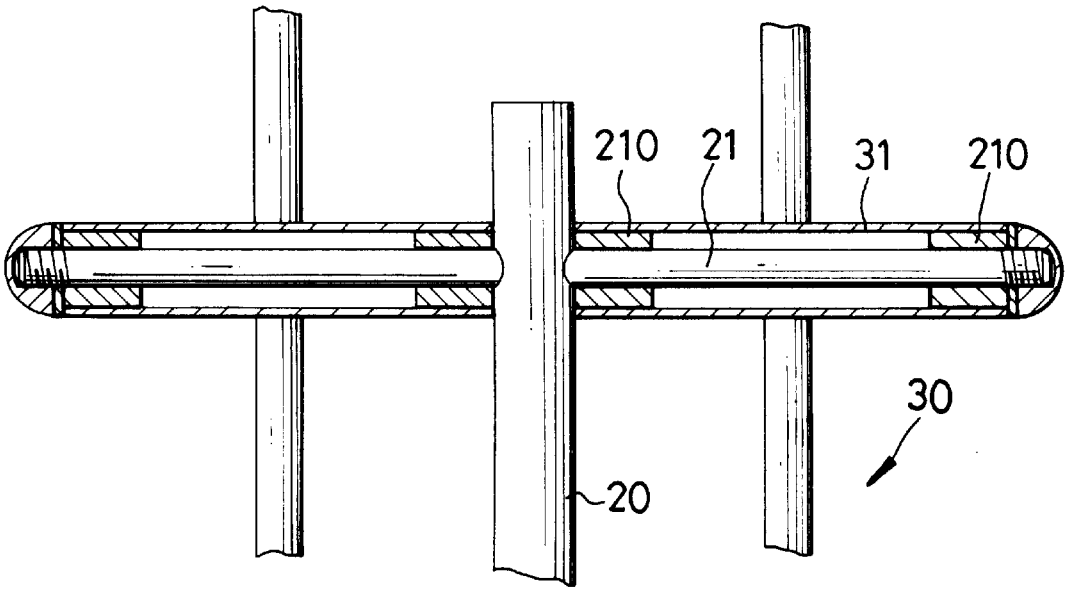
FIG. 3 is a partially cross-sectional view showing the relationship between a rod and a pair of dangling arms in accordance with the present invention.

Each of the dangling arms (30) has a tube (31) mounted on the top thereof to correspond to one side of the pole (21) and to pivotally receiving the pole (21) therein and a connecting tube (32) mounted on the bottom thereof. One pair of the dangling arms (30) each has an arcuate handle (33) rotatably connected thereto for the user to hold. To reduce the friction between the tube (31) and the pole (21), a pair of bushings (210) are provided therebetween, as shown in FIG. 3.

The slider (40) has a foot rest (41) mounted thereon and two pairs of oppositely extending parallel lugs (42) for pivotally connecting with the connecting tube (32). FIG. 2 shows that the lugs (42) of each pair are parallel to each other, such that each of the connecting tubes (32) can be pivotally received between the lugs (42). The pivotal connection between the lugs (42) and the connecting tube (32) is accomplished by a bolt and nut combination (neither numbered).

In the upper portion of the rod (20), a slit (25) is defined to correspond to the positioning hole (123) of the second bracket (12) of the base (10) and a pin (26) is provided to be inserted through the aligned slit (25) and the positioning hole (123), when the rod (20) connected with the first bracket (11) is pivoted toward the second bracket (12).

Figure 4:
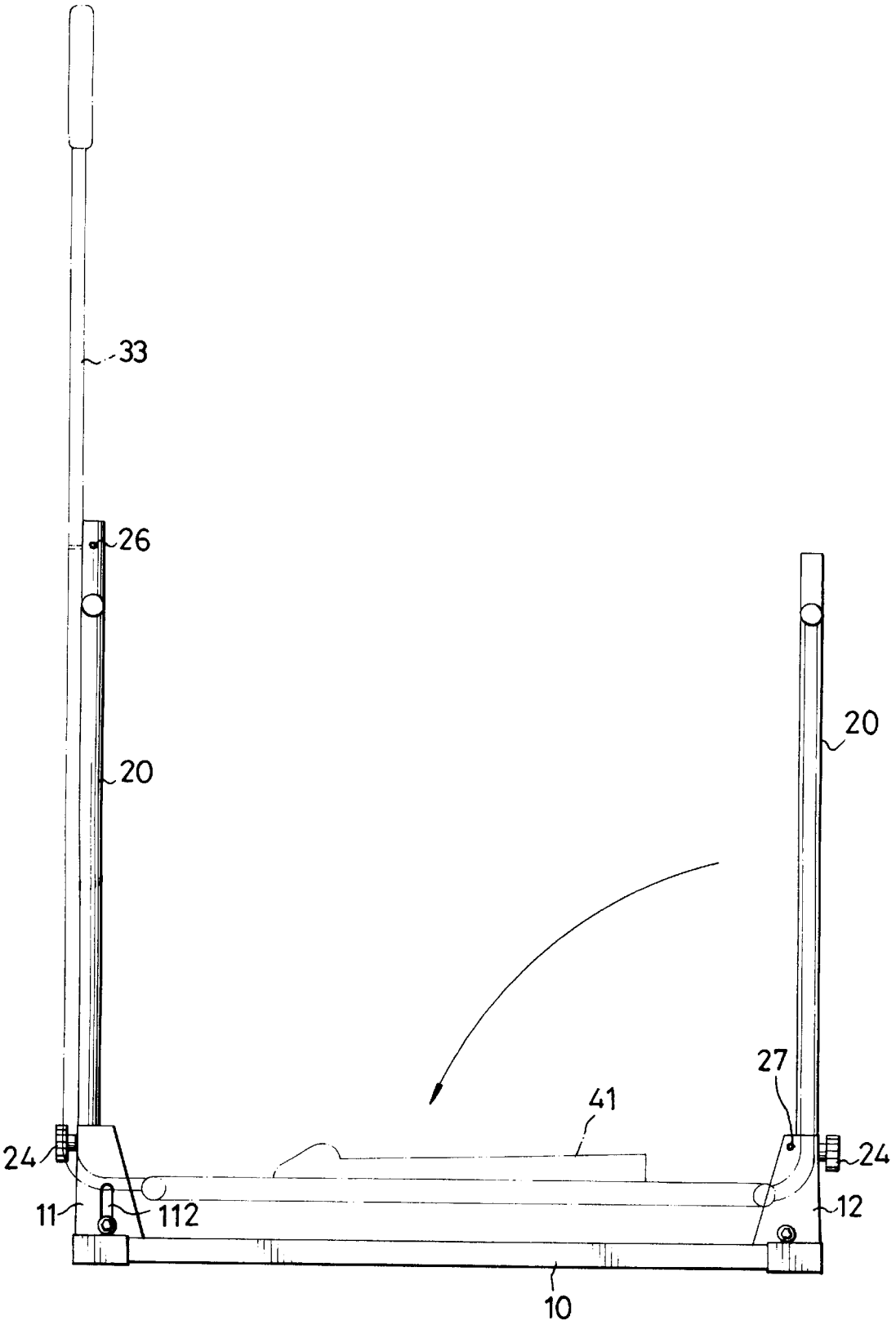
FIG. 4 is a side plan view of the exerciser in FIG. 1 showing the pivotal movement of the dangling arms with respect to the base.
Figure 5:
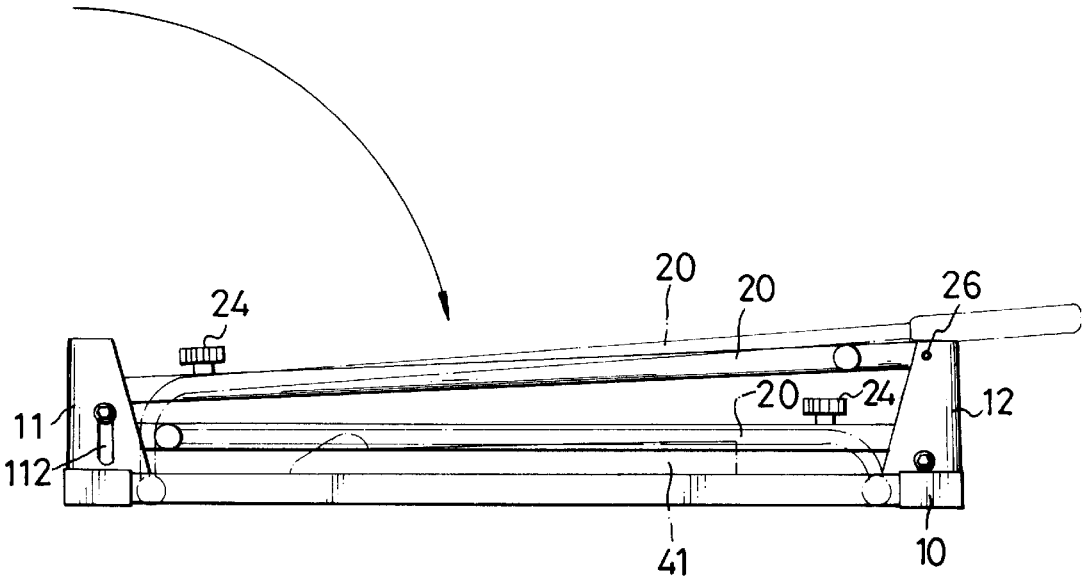
FIG. 5 is a partial cross sectional view of the exerciser in FIG. 1 lying on the ground in a folded state.

When the invention is assembled as shown in FIG. 1, the two pairs of the dangling arms (30) are pivotal with respect to the base (10) and the pair of the rods (20) are fixedly mounted on the base (10). However, when the exerciser is not in use, the user can first release the connection between the rods (20) with the base (10) by threadingly releasing the locking means (24). When the locking means (24) are released from the first and second brackets (11, 12), the rod (20) on the second bracket (12) is able to be folded counterclockwise and the rod (20) on the first bracket (11) is able to be folded clockwise. After the rod (20) on the second bracket (12) is folded, the rod (20) on the first bracket (11) is moved upward along the elongate through hole (112) and then folded on top of the folded rod (20), as shown in FIGS. 4 and 5. Thereafter, the slit (25) in the rod (20) on the first bracket (11) aligns with the positioning hole (123) of the second bracket (12). Then, the user uses the pin (26) to connect the rod (20) with the second bracket (12) by inserting the pin (26) into the aligned slit (25) and the positioning hole (123). When both of the rods (20) are folded and securely connected with the base (10), the two pairs of the dangling arms (30) are thus secured. To further reduce the space that the exerciser in accordance with the invention requires for storage, the pair of arcuate handles (33) can be disassembled from the opposite pair of dangling arms (39).

Figure 6:
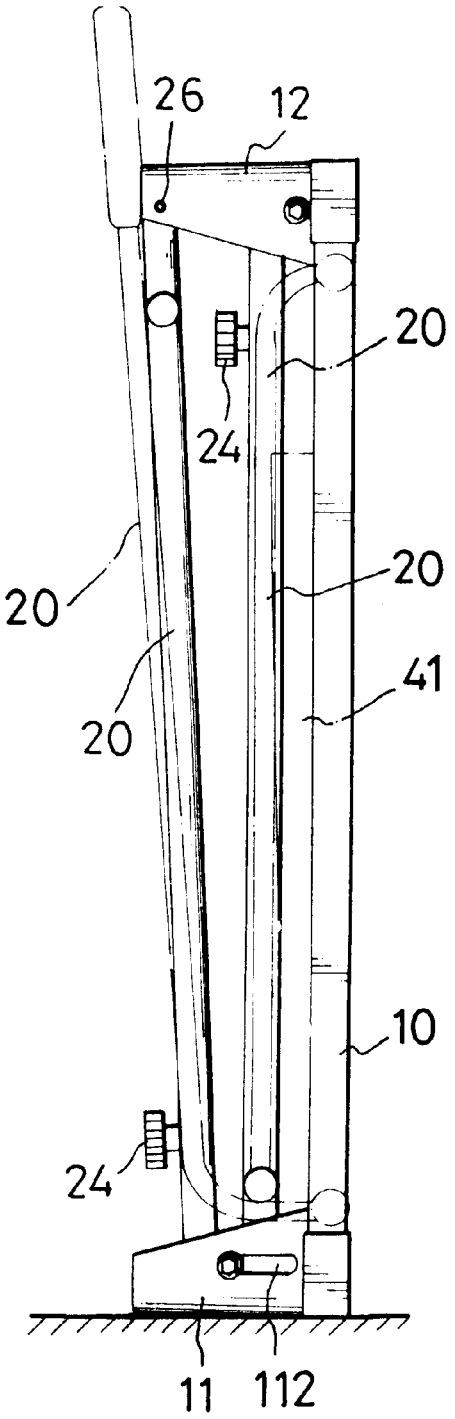
FIG. 6 is a side plan view of the exerciser in FIG. 1 in a folded state standing upright on the ground.
Figure 7:
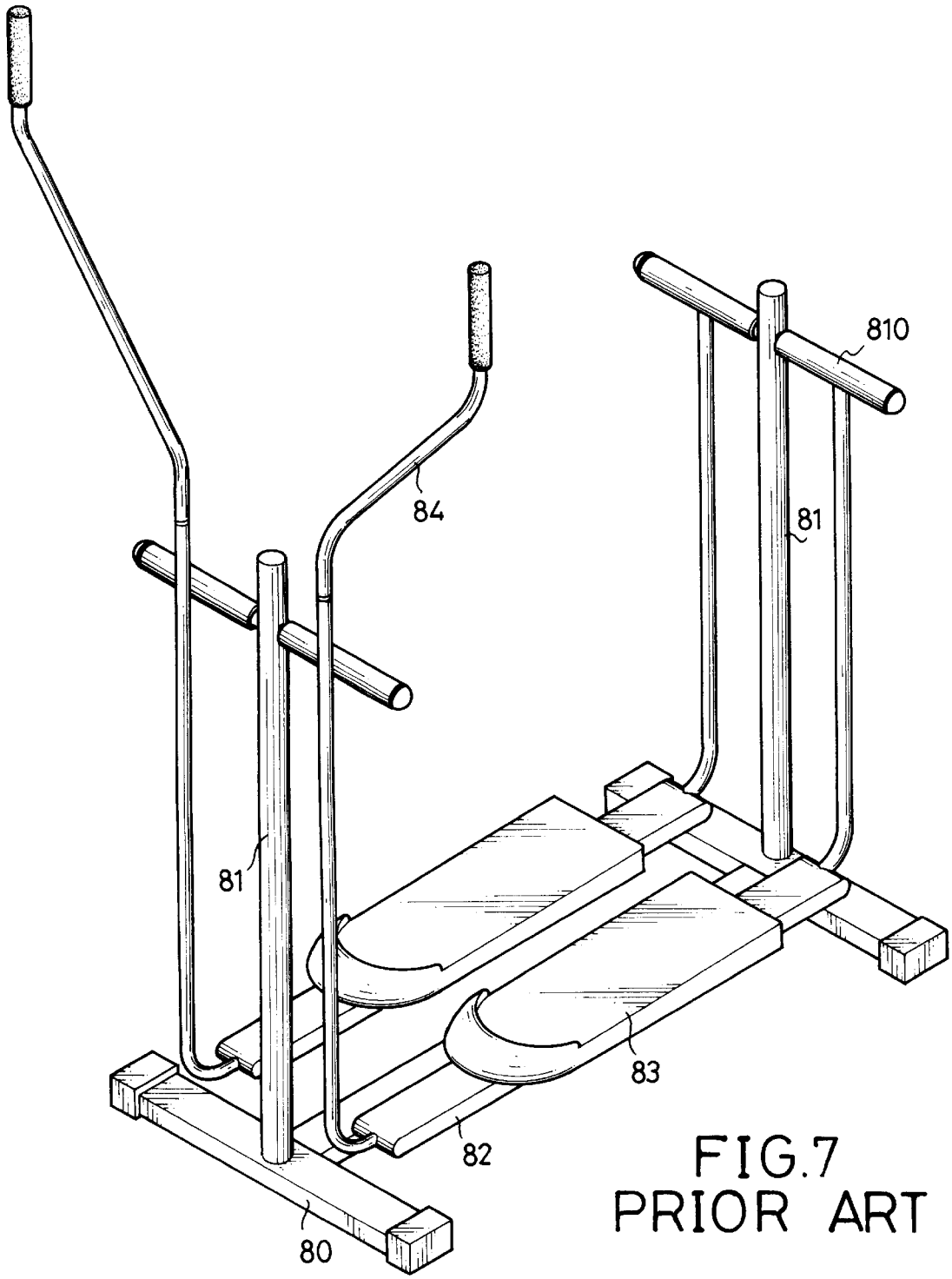
FIG.7 PRIOR ART
FIG. 7 is a perspective view showing a conventional cross-country skiing exerciser.

Referring to FIG. 6, another method to store the exerciser is to stand the exerciser on the first bracket (11), such that the space required to store the exerciser is greatly reduced.

Although the present invention has been explained in relation to its preferred embodiment, it is to be understood that many other possible modifications and variations can be made without departing from the spirit and scope of the invention as hereinafter claimed.

What is claimed is:

1. A foldable cross-country skiing exerciser comprising:

a base (10) having a hollow first bracket (11) and a hollow second bracket (12) securely mounted thereon, the first bracket (11) having an open side (110), a cutout (111), and an elongate through hole (112) defined therein, and the second bracket (12) having an open side (120), a cutout (121), and a pivot hole (122) defined therein, wherein the open side (110) of the first bracket (11) is opposite to the open side (120) of the second bracket (12) and wherein the cutout (111) of the first bracket (11) is opposite to the cutout (121) of the second bracket (12);

a pair of rods (20) each having a pole (21) extending through an upper portion thereof, and a connection tube (22) formed on a bottom thereof to be pivotally and respectively received in the first and second brackets (11,12), wherein each of the rods (20) has a through hole (23) peripherally defined therein and a locking means (24) threadingly inserted into the through hole (23), thereby selectively fixing the rods (20) with respect to the base (10);

two pairs of dangling arms (30), each dangling arm (30) having a tube (31) on a top thereof for pivotal connection with one side of the pole (21) and a connecting tube (32) on a bottom thereof; and a pair of sliders (40) each pivotally connected between opposite dangling arms (30) and each having a foot rest (41) thereon for receiving a foot therein and two pairs of lugs (42), each pair of lugs (42) being parallel with each other so as to receive the connecting tube (32) therebetween; whereby after the rod (20) in the second bracket (12) is folded, the rod (20) in the first bracket (11) is moved upward along the elongate through hole (112) and folded on top of the folded rod (20) in the second bracket (12).

2. The exerciser as claimed in claim 1, wherein the rod (20) in the first bracket (11) is movable along the elongate through hole (112).

3. The exerciser as claimed in claim 2, wherein the base (10) is I-shaped.

* * * * *